United States Patent [19]

Perrone

[11] Patent Number: 5,029,503

[45] Date of Patent: Jul. 9, 1991

[54] CHOPPER

[75] Inventor: Robert W. Perrone, Elmhurst, Ill.

[73] Assignee: Perrone Bros. Equipment Co., Bellwood, Ill.

[21] Appl. No.: 346,922

[22] Filed: May 3, 1989

[51] Int. Cl.[5] ..... B26D 5/10

[52] U.S. Cl. ..... 83/62; 83/374

[58] Field of Search ..... 83/62, 62.1, 374, 375, 83/467.1, 468.5

[56] References Cited

U.S. PATENT DOCUMENTS

| | | | |
|---|---|---|---|
| 1,233,355 | 7/1917 | Henderson | 83/374 |
| 1,714,382 | 5/1929 | Lebovitz | 83/374 |
| 2,364,716 | 12/1944 | Huebrer et al. | 83/62 X |
| 2,591,592 | 4/1952 | Nasmith | 83/62 |
| 3,146,650 | 9/1964 | Sarring et al. | 83/375 X |
| 3,589,225 | 6/1971 | Wiatt | 83/375 X |
| 3,710,665 | 1/1973 | Eddy | 83/374 |
| 4,664,004 | 5/1987 | Randall | 83/375 X |

*Primary Examiner*—Timothy V. Eley

*Attorney, Agent, or Firm*—Hill, Van Santen, Steadman & Simpson

[57] ABSTRACT

A chopper for collated sheets of paper having a fixed blade and a pivotally movable blade for effecting scissors like chopping action. An electric motor drives a flywheel which is connected through a clutch mechanism to a crank arm which is in turn connected to the chopping blade. The clutch mechanism normally holds the chopping blade stationary until an electrical signal is sent to actuate the clutch permitting a single reciprocating movement of the chopping blade. A magnetic switch and time delay mechanism are provided to detect jamming of the chopping blade, and if jamming is detected, the motor is deactivated.

15 Claims, 5 Drawing Sheets

122
124
130
132
TIME DELAY
134
136
12
M
N
N
N
N
N
N
220V

CHOPPER

BACKGROUND OF THE INVENTION

This invention relates to choppers and more particularly to a chopper for multi-sheet stacks of collated papers.

Choppers for sheets of collated papers generally incorporate hydraulic choppers in which a blade is positioned on the end of a hydraulic ram and reciprocated toward and away from the stack of collated papers. Such hydraulic choppers have many drawbacks including slow speed.

It would therefore be an improvement in the art to provide a chopper which had a faster speed of operation than presently available choppers.

It would be a further improvement in the art to provide a chopper which is economical to build and easy to use and highly accurate in its chopping.

SUMMARY OF THE INVENTION

The present invention provides a chopper which has a scissors-like chopping or cutting action accomplished by operation of a crank arm attached to a fly wheel through a clutch mechanism. The fly wheel is continuously in motion and the clutch provides selective operation of the crank arm to cause a pivoting reciprocation of the chopper blade to effect the chopping action.

A stack of collated papers is held down on a fixed blade and a signal is sent to the clutch to cause rotation of a shaft carrying the crank arm. The fly wheel is sufficiently massive to assure that the movable chopping blade will cut or chop through the entire stack of papers. The clutch mechanism permits only a single revolution of the crank arm which is then held stationary until a subsequent signal is sent to the clutch mechanism.

A jamming detector is provided to cause deactivation of the motor in the event the chopping blade becomes jammed and is unable to further cut the stack of papers.

It is therefore a principal object of this invention to provide an improved chopper having a pivoted blade to provide the chopping action.

It is another and more particular object of this invention to provide a chopper in which the blade movement is caused by activation of a clutch mechanism permitting a single chopping action by the blade.

It is a specific object of this invention to provide an improved chopper which is economical to build and safe and easy to use.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
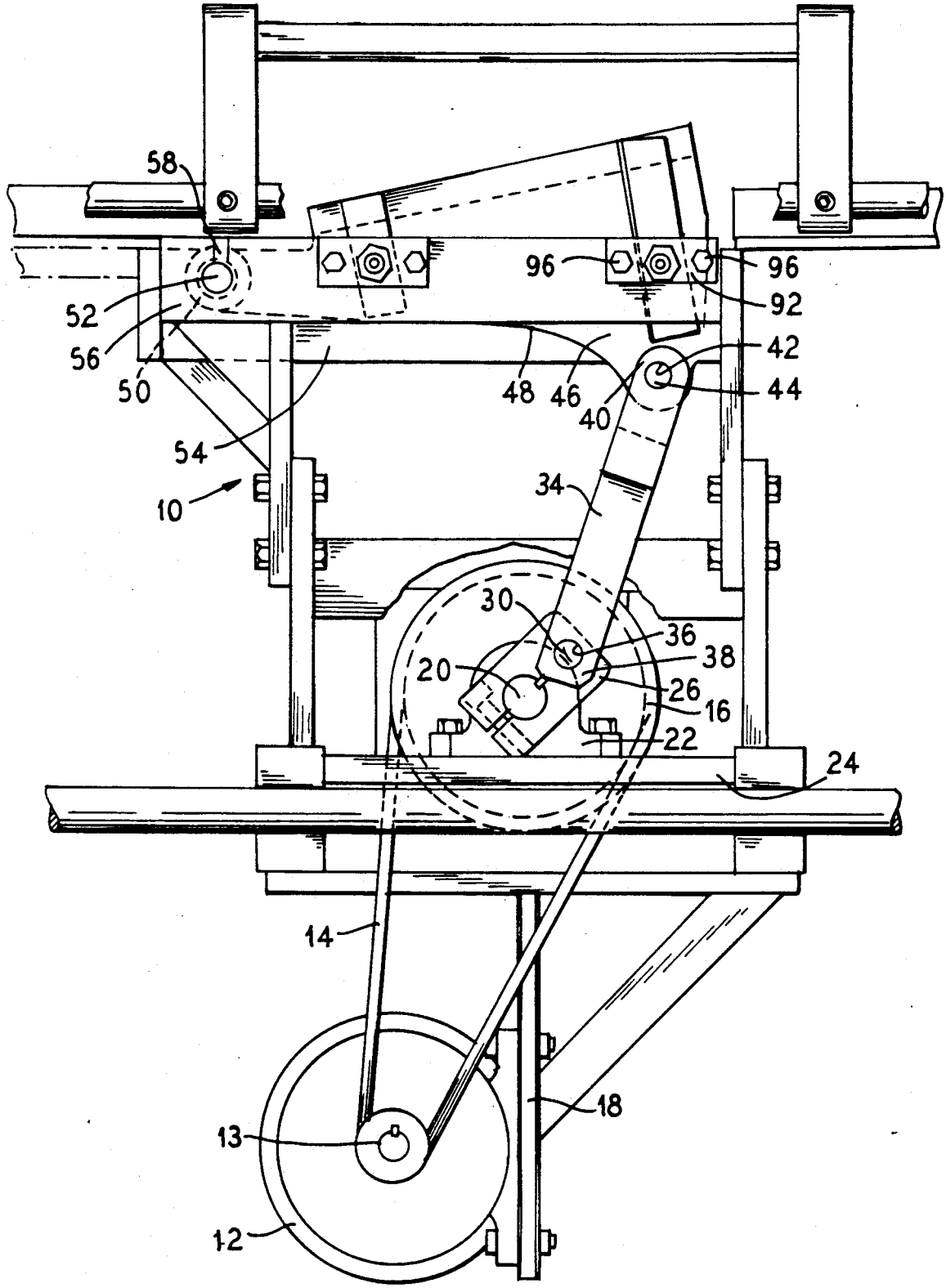
FIG. 1 is a rear elevational view of a chopper embodying the principles of the present invention.
Figure 2:
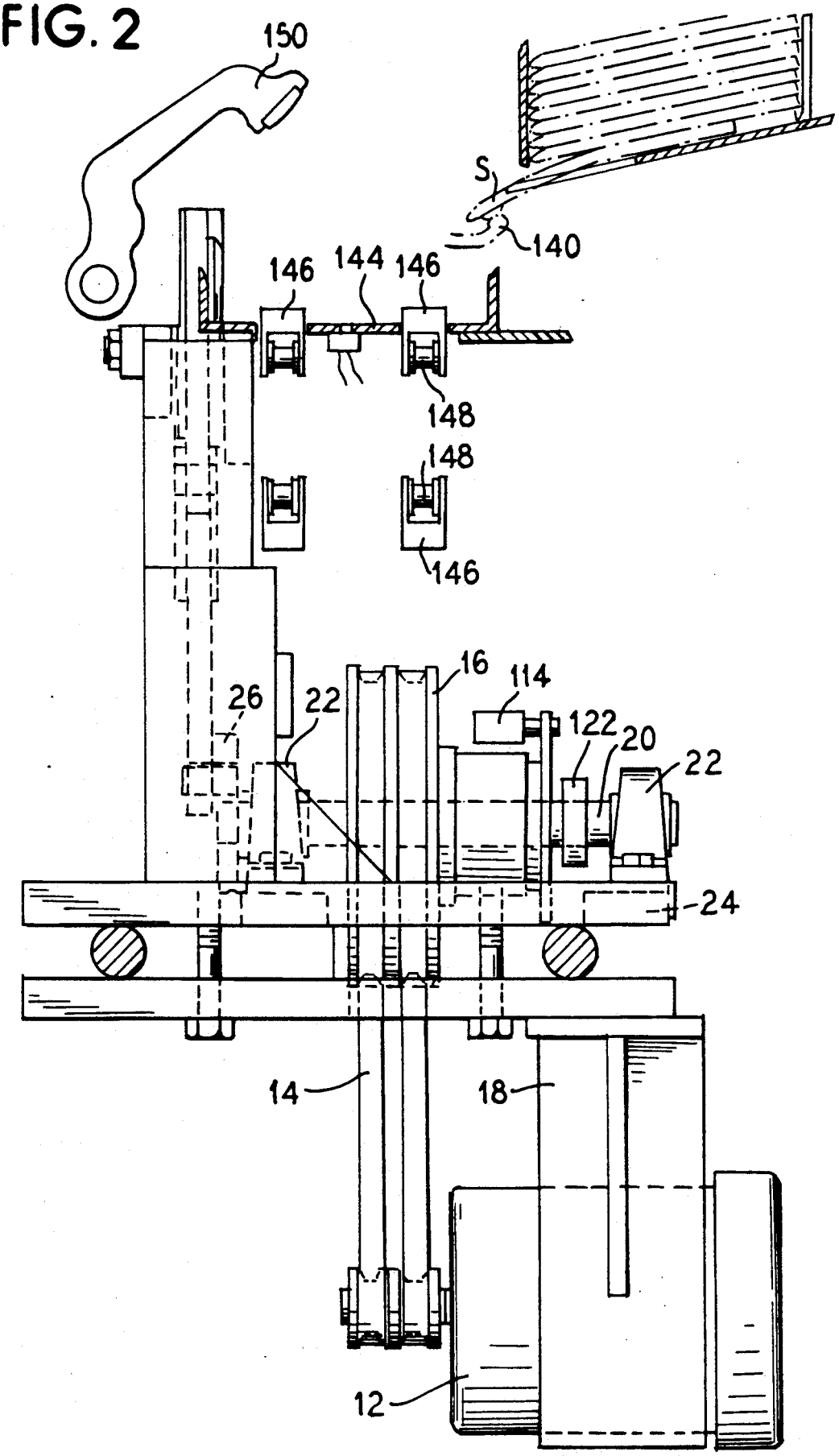
FIG. 2 is a side elevational view of the chopper of FIG. 1.

FIG. 1 illustrates a chopper mechanism generally at 10 which includes an electric motor 12 having a rotating shaft 13 connected by a drive belt 14 to a fly wheel pulley 16. The motor is secured to a frame member 18 of the chopper mechanism 10 below the fly wheel 16. The fly wheel 16 is carried on a shaft 20 which is journelled in bearings 22 which are mounted on a pair of cross frame members 24.

A crank 26 is carried on an end 28 of the shaft 20 and carries a pivot pin 30 radially spaced from an axis 32 of the shaft 20. A crank arm 34 is attached to the pivot pin 30 by means of an aperture 36 in a first end 38 of the crank arm 34. An opposite end 40 of the crank arm 34 has an aperture 42 therethrough which receives a pivot pin 44 that is secured to a chopping blade carrier 46 near a lower edge 48 thereof.

Figure 3:
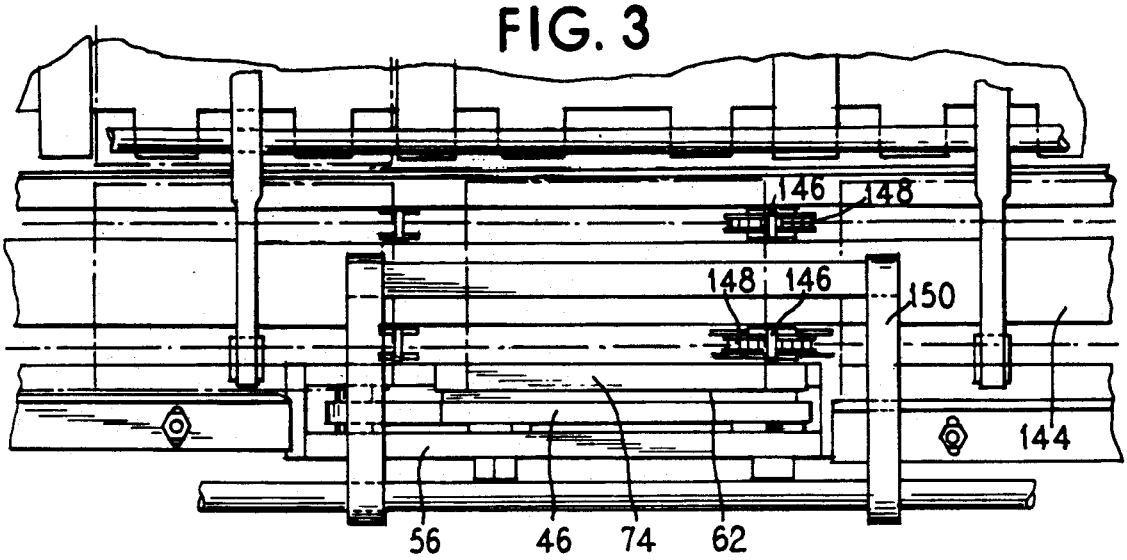
FIG. 3 is a top elevational view of the chopper of FIG. 1.
Figure 4:
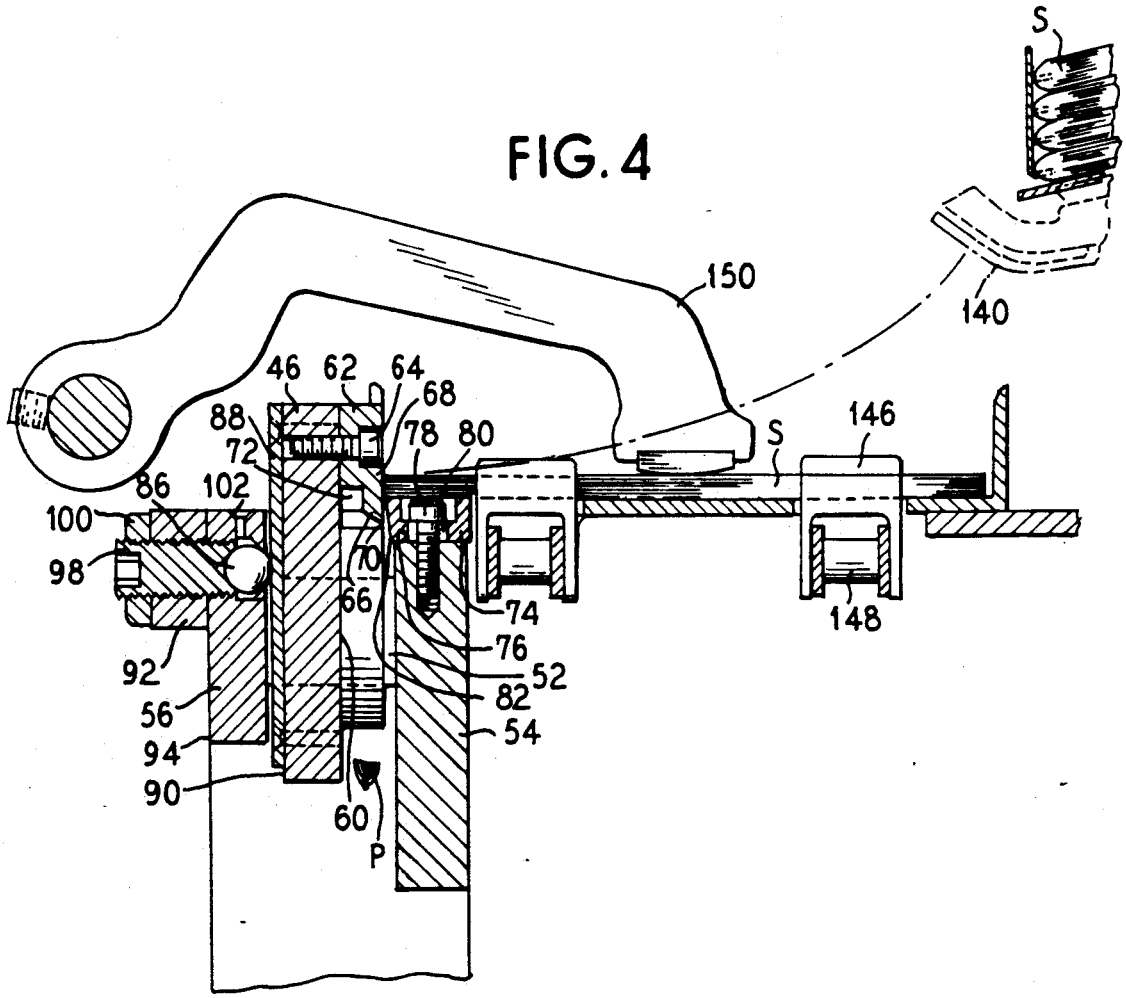
FIG. 4 is a cross-sectional view taken along the lines IV—IV of FIG. 3.
Figure 6:
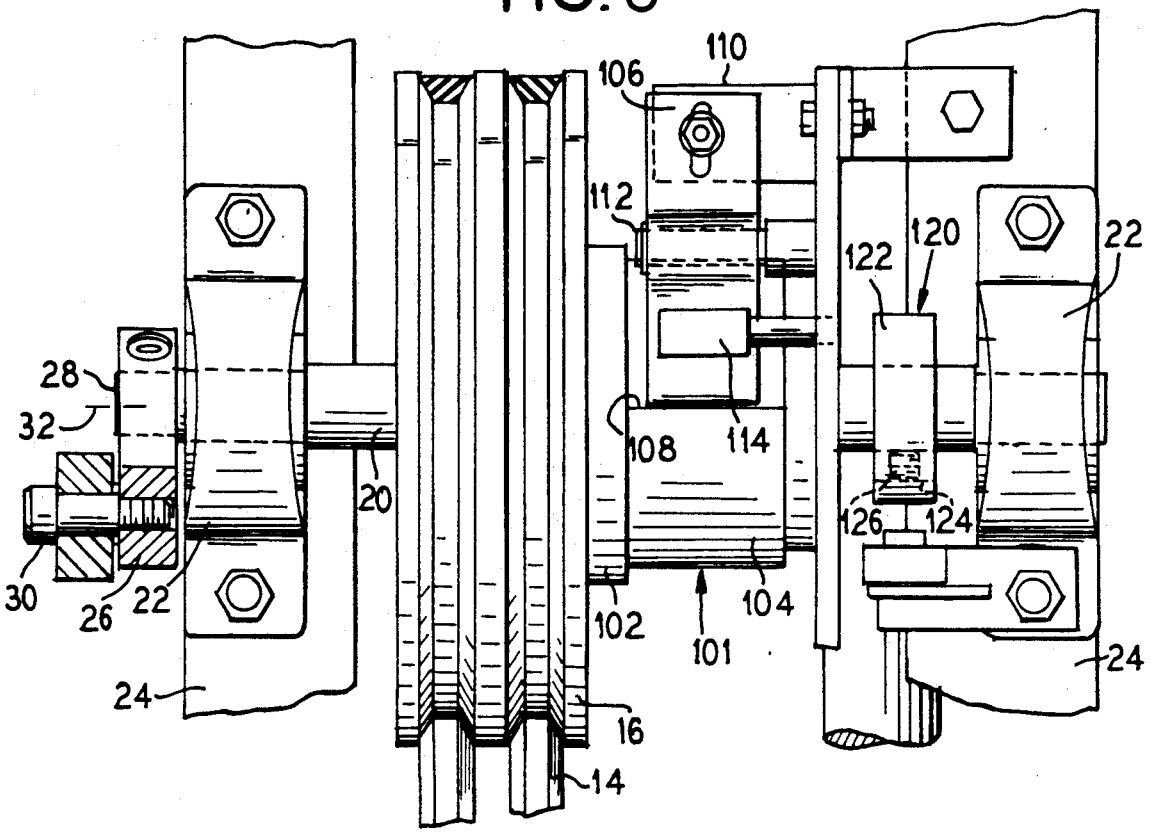
FIG. 6 is a top sectional view of the drive pulleys and clutch mechanism, taken along the lines VI—VI of FIG. 2.

The chopping blade carrier 46 is pivotally mounted near one end 50 by means of a pivot shaft 52 which is secured to frame elements 54, 56 (FIG. 4) by appropriate fastening means 58 such as set screws. Thus, the chopping blade carrier 46 is carried between the frame elements 54, 56 (FIG. 3). The chopping blade carrier 46 has secured to a front face 60 thereof a chopping blade 62 by appropriate fastening means such as threaded fasteners 64. The chopping blade 62 has a lower edge 66 which is angled downwardly toward a front face 68 of the blade and a junction 70 between the lower edge 66 and front face 68 forms a chopping or cutting edge of the chopping blade. A rear portion 72 of the lower edge 66 is relieved to reduce any buildup of pressure by the material being chopped.

A fixed blade 74 is secured to a top edge 76 of the frame member 54 by appropriate fastening means 78 such as threaded fasteners which extend through openings 80 formed in the top of the fixed blade 74. The openings 80 are elongated to permit the blade 74 to be adjusted toward or away from the chopping blade 62 to assure close engagement between the fixed blade 74 and the chopping blade 62. A forward edge 82 of the fixed blade 74 is angled slightly away from the chopping blade 62 to prevent a binding of the material being chopped by the chopping blade 62.

The chopping blade 62 is continuously pressed toward the fixed blade 74 by means of a pair of roller balls 86 which are captured in the frame member 56 and which are continuously pressed against a pair of hardened metal plates 88 secured to a rear face 90 of the chopping blade carrier 46. A plate 92 is secured to a rear face 94 of the frame member 56 by appropriate fastening means 96 such as threaded fasteners and which threadinqly receive a screw member 98 which engages against a backside of the ball 86 to press it against the hardened metal plate 88. A lock nut 100 holds the screw 98 in the plate 92 against the ball 86. A lubricating aperture 102 is provided in the frame member 56 to assure easy movement of the ball 86. The screw 98 can be adjusted to apply greater or lesser pressure against the ball 86.

Figure 5:
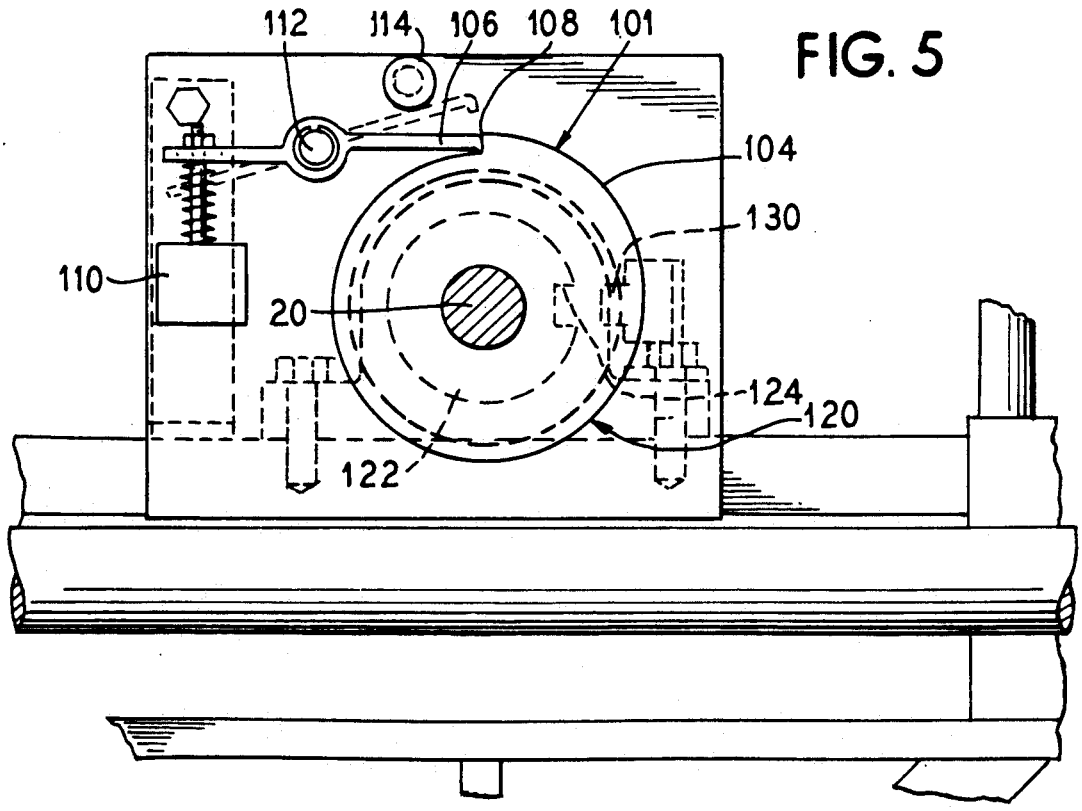
FIG. 5 is a front view of the clutch mechanism used in the chopper of FIG. 1.

The pulley 16 is connected to the shaft 20 through the intermediary of a clutch mechanism 101 which permits a continuous rotation of the pulley 16 without transmitting such rotation to the shaft 20 until the clutch is actuated. A clutch which Applicant has found to be particularly useful in this arrangement is sold by Warner Electric Brake and Clutch Company as a CB-6 Model S Incremental Rotation Control Package. Briefly, the pulley 16 is mounted on an input hub 102 which is free to rotate within a control collar 104. The control collar 104 is normally held stationary by an actuator 106 which is pivotable between a stop position which holds the control collar 104 against rotation by engaging a step 108 on the outer circumference of the collar, and a release position (as shown in phantom lines in FIG. 5) which permits the control collar to rotate. A solenoid 110 is connected to an end of the actuator 106 opposite a central pivot 112 to cause the disengagement of the actuator from the step 108. Only a momentary energization of the solenoid 110 occurs which disengages the actuator 106 from the step 108. A post 114 is provided to prevent over travel of the actuator 106. Immediately thereafter the actuator 106 moves back toward the latching position and rides along the circumference of the control collar 104 until the control collar returns to the original position. In this manner, a single rotation of the control collar occurs each time the solenoid 110 is actuated. When the control collar 104 rotates, a drive spring (not shown) internal of the clutch mechanism tightens on an output shaft which is secured to the shaft 20 carrying the crank 26. Thus, actuation of the solenoid 110 causes a 360° rotation of the crank 26.

Figure 7:
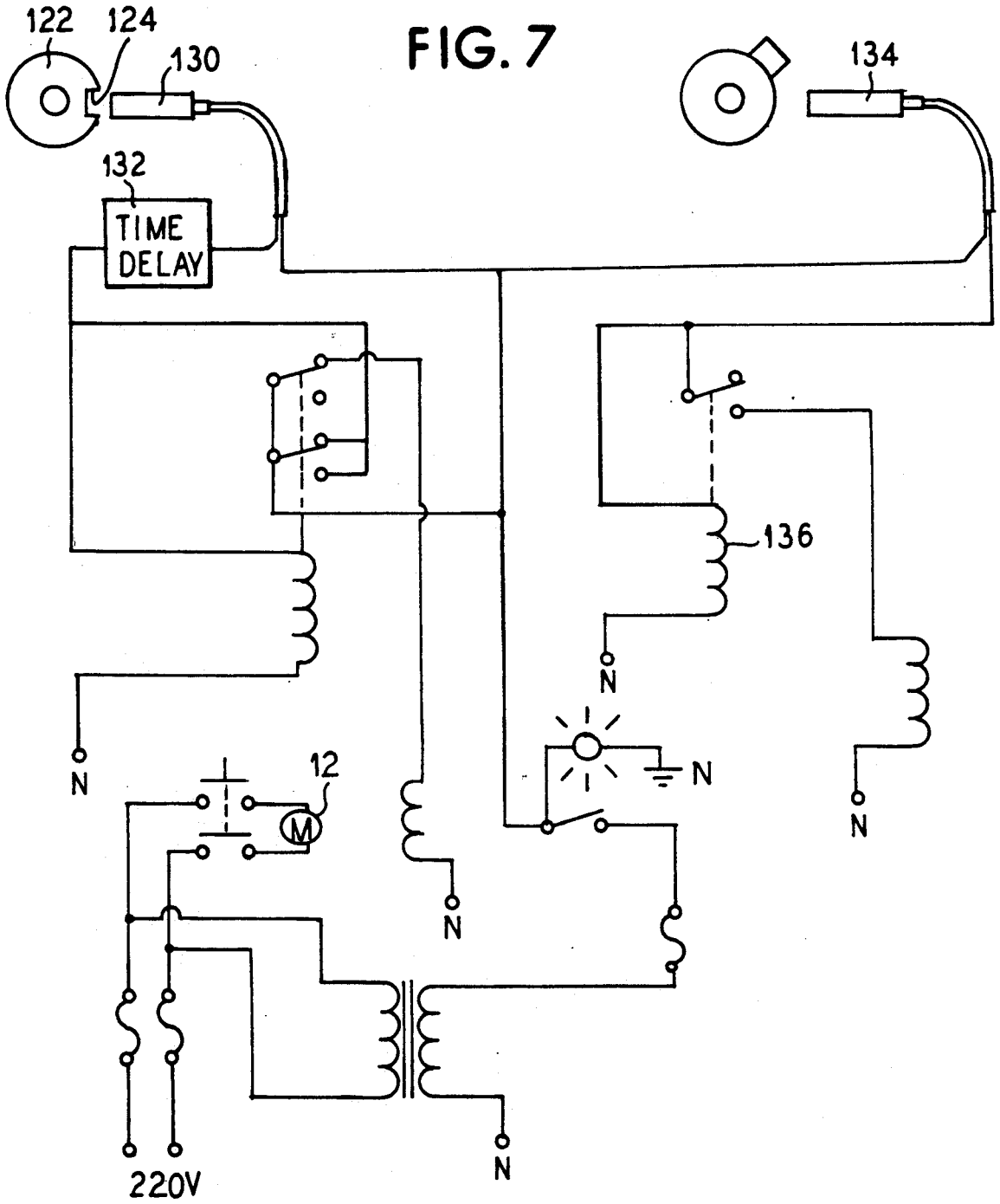
FIG. 7 is an electrical schematic diagram of a control circuit of the present invention.

A jam detector 120 is provided for detecting a stoppage of movement of the chopping blade 62 during the time in which the chopping blade is to be moving which comprises a cam member 122 carried on shaft 20 which has a recess 124 along a portion of the circumference of the cam. The cam is fixed to the shaft 20 by appropriate means such as a set screw 126 so that it corotates with the shaft 20. Positioned directly across from the normal at rest position of the recess 124 of the cam 122 is a magnetic switch 130 which can sense the proximity of a metallic member. As the cam 122 rotates with the shaft 20 the magnetic switch 130 detects the circumferential surface of the cam which causes the switch 120 to close from its normal open position when the recess 124 lies directly opposite the switch. A time delay mechanism 132 is provided (FIG. 7) which permits the switch 130 to remain open for a predetermined length of time to permit complete rotation of the cam 122. If the switch remains open for a longer period of time, it means that the cam, and thus the shaft 20 has not completed a full rotation, thus indicating a jam. When this occurs, the motor is deenergized or deactivated to avoid damage to the device.

The chopper finds particular utility in a document assembly operation wherein stacks of collated sheets of papers are bound into books in a spine stapled arrangement. Individual stapled stacks of collated sheets or books are drawn from the group of books by a suitable retracting mechanism 140 and dropped onto a conveyor bed 144 where they are carried along by upstanding fingers 146 secured to moving conveyor chains 148 in an endless belt arrangement. As an individual stack of collated sheets S is dropped onto the conveyor 144, a hold down arm 150 is rotated down to press against the stack of sheets and, upon such rotation, a switch 134 (FIG. 7) is closed which activates a solenoid 136 to energize the clutch solenoid 110. This causes the actuator 106 to disengage from the control collar 104 causing shaft 20 and thus crank 26 to rotate. The crank arm 34 connected to the chopper blade carrier 46 draws the chopper blade downwardly from an elevated at rest position such that the chopping blade 62 engages the book of collated papers in a scissors-like manner to sever the stapled spine portion P from the remainder of the book. The chopper blade carrier 46 then rotates back to the elevated position once the chopping is complete and the stack is free to be incrementally moved to the next operation station. Subsequently, a further stack of materials is drawn onto the conveyor belt and the process is repeated.

Thus, it is seen that a chopper is provided which has a fixed blade, a chopping blade pivotally movable relative to the fixed blade and means for pivotally moving the chopping blade relative to the fixed blade in a single reciprocating action in response to a predetermined event, such as rotation of a hold down arm 150. There is also provided a means for holding the chopping blade stationary relative to the fixed blade at all times other than immediately following the occurrence of the predetermined event, such as the clutch mechanism specifically disclosed. Still further, there is a means for detecting a stoppage of movement of the chopping blade during the time in which the chopping blade is to be moving and also means for deactivating the means for moving the chopping blade upon detection of the stoppage of movement of the chopping blade.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A chopper comprising:

a fixed blade;

a chopping blade means pivotally movable relative to said fixed blade;

means for pivotally moving said chopping blade means relative to said fixed blade in a single reciprocating action in response to a predetermined event, wherein said predetermined event comprises a change in the position of a movable portion of said chopper;

means for holding said chopping blade means stationary relative to said fixed blade at all times other than immediately following the occurrence of said event;

means for detecting a stoppage of movement of said chopping blade means during the time in which said chopping blade means is to be moving immediately following the occurrence of said event; and means for deactivating said means for moving said chopping blade means upon detection of said stoppage of movement of said chopping blade means.

2. A chopper according to claim 1, wherein said means for pivotally moving said chopping blade means comprises a motor with a rotating shaft connected through a clutch mechanism to a crank arm attached to said chopping blade means.

3. A chopper according to claim 2, wherein said chopping blade means comprises a chopping blade carrier pivotally mounted relative to said fixed blade and a chopping blade securely attached to said chopping blade carrier, said crank arm being pivotally attached to said chopping blade carrier.

4. The chopper according to claim 2, wherein said clutch mechanism includes an actuating means which prevents rotary motion of said rotating shaft from being transferred to said crank arm.

5. A chopper according to claim 4, including a solenoid connected to said actuating means for releasing said actuating means from said clutch mechanism in response to the predetermined event.

6. A chopper according to claim 1, wherein said means for holding said chopping blade means stationary comprises a clutch mechanism between said means for pivotally moving said chopping blade means and said chopping blade means, said clutch mechanism being selectively engaged in response to the predetermined event to permit movement of said chopping blade means.

7. A chopper according to claim 1, wherein said means for detecting a stoppage of movement of said chopping blade comprises a magnetic switch for detecting the movement of said chopping blade and a time delay mechanism for providing a sufficient length of time for said chopping blade to make a complete reciprocating motion before said means for deactivating begins to operate.

8. A chopper according to claim 1, wherein said means for pivotally moving said chopping blade means is energized by electrical power to provide said movement and said means for deactivating comprises a solenoid actuated switch which is connected to said means for pivotally moving said chopping blade means and which disconnects the power supply to said means for pivotally moving.

9. A chopper according to claim 8, wherein said predetermined event comprises an electrical signal generated upon said change of position.

10. A chopper comprising:

a fixed blade;

a chopping blade means pivotally movable relative to said fixed blade, comprising a chopping blade carrier pivotally mounted relative to said fixed blade and a chopping blade securely attached to said chopping blade carrier;

means for pivotally moving said chopping blade means relative to said fixed blade in a single reciprocating action in response to a predetermined event, wherein said predetermined event comprises a change in the position of a movable portion of said chopper, comprising an electric motor with a rotating shaft connected through a clutch mechanism to a crank arm attached to said chopping blade carrier, said clutch mechanism including an actuating means which prevents rotary motion of said rotating shaft from being transferred to said crank arm, and a solenoid connected to said actuating means for releasing said actuating means from said clutch mechanism in response to the predetermined event;

means for holding said chopping blade means stationary relative to said fixed blade at all times other than immediately following the occurrence of said event, comprising said clutch mechanism, said clutch mechanism being selectively engaged in response to the predetermined event to permit movement of said chopping blade means;

means for detecting a stoppage of movement of said chopping blade means during the time in which said chopping blade means is to be moving immediately following the occurrence of said event, comprising a magnetic switch for detecting the movement of said chopping blade and a time delay mechanism for providing a sufficient length of time for said chopping blade to make a complete reciprocating motion before said means for deactivating begins to operate; and means for deactivating said motor upon detection of said stoppage of movement of said chopping blade means, comprising a solenoid actuated switch which is connected to said means for pivotally moving said chopping blade means and which disconnects the power supply to said motor.

11. A chopper for chopping stacks of collated paper comprising a fixed blade having a top surface for receiving a portion of said stack to be chopped, an edge of said fixed blade defining a line along which said stack is to be chopped, a pivotable chopping blade normally held above said fixed blade and having an edge movable toward said fixed blade edge so as to cause a scissors like chopping action between said blades, an electrical motor with a rotating shaft output connected to a flywheel carried on a shaft, said flywheel shaft being connected to a clutch mechanism which permits rotation of said flywheel without transmission of said rotation until said clutch mechanism is actuated, said clutch mechanism being connected to a crank shaft and crank arm which are in turn connected to said pivotable chopping blade, an actuating means effective to actuate said clutch to transmit the rotation of said flywheel shaft to said crank arm in response to an electrical signal, a means for detecting a jamming of said chopping blade as it is moving toward or away from said fixed blade, and means for deactivating said motor when said detecting means detects a jam.

12. A chopper according to claim 11, wherein said actuating means causes a single reciprocating movement of said chopping blade in response to said electrical signal.

13. A chopper for chopping stacks of collated paper comprising a fixed blade having a top surface for receiving a portion of said stack to be chopped, an edge of said fixed blade defining a line along which said stack is to be chopped, a pivotable chopping blade normally held above said fixed blade and having an edge movable toward said fixed blade edge so as to cause a scissors like chopping action between said blades, an electrical motor with a rotating shaft output connected to a flywheel carried on a shaft, said flywheel shaft being connected to a clutch mechanism which permits rotation of said flywheel without transmission of said rotation until said clutch mechanism is actuated, said clutch mechanism being connected to a crank shaft and crank arm which are in turn connected to said pivotable chopping blade, an actuating means effective to actuate said clutch to transmit the rotation of said flywheel shaft to said crank arm in response to an electrical signal, a means for detecting a jamming of said chopping blade as it is moving toward or away from said fixed blade comprising a magnetic switch and time delay mechanism.

14. A chopper according to claim 1, wherein said change of position comprises movement of a hold down arm associated with said chopper.

15. A chopper according to claim 10, wherein said change of position comprises movement of a hold down arm associated with said chopper.

* * * * *